US005629124A

United States Patent [19]

Ono et al.

[11] Patent Number: 5,629,124

[45] Date of Patent: May 13, 1997

[54] CHARGE CONTROLLING AGENT FOR ELECTROSTATIC IMAGE DEVELOPMENT, AND TONER AND CHARGE-IMPARTING MATERIAL EMPLOYING IT

[75] Inventors: Hitoshi Ono; Noriaki Takahashi; Osamu Ando; Masako Takeuchi, all of Yokohama, Japan

[73] Assignee: Mitsubishi Chemical Corporation, Tokyo, Japan

[21] Appl. No.: 593,705

[22] Filed: Jan. 29, 1996

[30] Foreign Application Priority Data

| | | | |
|---|---|---|---|
| Jan. 31, 1995 | [JP] | Japan | 7-014157 |
| Jul. 26, 1995 | [JP] | Japan | 7-190653 |
| Nov. 10, 1995 | [JP] | Japan | 7-292565 |

[51] Int. Cl.[6] ..... G03G 9/097

[52] U.S. Cl. ..... 430/110; 430/97; 430/108; 361/226; 389/55

[58] Field of Search ..... 430/97, 108, 110; 118/653; 361/226

[56] References Cited

U.S. PATENT DOCUMENTS

| | | | |
|---|---|---|---|
| 4,099,968 | 7/1978 | Scouten et al. | 430/110 |
| 4,710,443 | 12/1987 | Tanaka et al. | 430/106.6 |
| 5,034,300 | 7/1991 | Anno et al. | 430/108 X |
| 5,200,288 | 4/1993 | Ando et al. | 430/110 |
| 5,385,799 | 1/1995 | Ono et al. | 430/110 |
| 5,391,454 | 2/1995 | Mukudai et al. | 430/110 |
| 5,405,727 | 4/1995 | Wilson et al. | 430/110 |

FOREIGN PATENT DOCUMENTS

| | | |
|---|---|---|
| 0548772 | 6/1993 | European Pat. Off. . |
| 6-266170 | 9/1994 | Japan . |
| 6-258871 | 9/1994 | Japan . |

*Primary Examiner*—Roland Martin

*Attorney, Agent, or Firm*—Oblon, Spivak, McClelland, Maier & Neustadt, P.C.

[57] ABSTRACT

A charge controlling agent for electrostatic image development, which is a compound of the formula (I):

$$Ar_1—(X—Ar_2)_n \quad (I)$$

wherein each of $Ar_1$ and $Ar_2$ is a substituted or unsubstituted aromatic ring residue, X is a member selected from the group consisting of —CONH—, —NHCO—, —$SO_2$NH— and —NH$SO_2$—, and n is an integer of at least 2, provided that a plurality of $Ar_2$, or a plurality of X, are the same or different groups from one another, and toner and charge-imparting material employing the charge controlling agent.

34 Claims, No Drawings

CHARGE CONTROLLING AGENT FOR ELECTROSTATIC IMAGE DEVELOPMENT, AND TONER AND CHARGE-IMPARTING MATERIAL EMPLOYING IT

The present invention relates to a charge controlling agent for electrostatic image development to be used for e.g. an electrophotographic copying machine, and a toner and a charge-imparting material to impart an electric charge to a toner useful for development of an electrostatic image, wherein such a charge controlling agent is used.

A developer for e.g. an electrophotographic copying machine is, in a developing step, once deposited on an image-carrier such as a photoreceptor on which an electrostatic image is formed, then in a transfer step, transferred from the photoreceptor to a transfer paper and then in a fixing step, fixed on a copying paper. Here, as the developer for developing the electrostatic image formed on the latent image-maintaining surface, a two-component developer comprising a carrier and a toner and a one-component developer (magnetic toner) requiring no carrier, are known.

One of the important properties required for a toner is an electric charge. A toner is required to have a positive or negative charge of a proper level when contacted with a carrier or with a wall of a developing apparatus, and the level of the charge is required to be substantially stable with time even during continuous use or in an adverse environment. An electric charge may be imparted to the toner by a binder resin or the colorant itself, but no adequate electric charge can thereby be imparted. Therefore, as an agent (a charge controlling agent) to impart an electric charge to a toner, it has been known to incorporate to a toner a positive charge-imparting Nigrosine dye or quaternary ammonium salt, or a negative charge-imparting metal-containing monoazo dye, salicylic acid/metal complex or copper phthalocyanine pigment.

However, these conventional charge controlling agents have some problems with respect to the charge-imparting effects or other properties required for a toner. One of the problems is the safety of the toner. Conventional charge controlling agents, particularly negative charge-imparting materials, have been mainly of a metal dye type containing a metal such as chromium, since a high level of electric charge can thereby be imparted. However, it is desirable not to use a metal, such as chromium, which is doubtful about the safety, as a component of a material like a toner which is used in the vicinity of human. In recent years, a voice calling for the importance of such safety has been increasingly high. Accordingly, also for the toner, it is desired to develop a charge controlling agent which contains no metal such as chromium and which has a charge-imparting property better than the conventional agents and is excellent also in other properties required for the toner.

A second problem for the toner may be the charge stability. Conventional charge controlling agents are, in many cases, inadequate in the charge stability although their charge level may be high, and thus have a problem such that the charge level changes with time during continuous copying or continuous printing, whereby copy staining tends to result. Such a problem is certainly increasing especially in recent years, since copying machines capable of treating a large number of copies continuously at a high speed, are desired. Accordingly, it is desired to develop a charge controlling agent having a better charge stability.

On the other hand, an attempt to improve the properties to impart an electric charge to a toner has been conducted not only by means of the above-described charge controlling agent but also by means of a transporting, regulating or friction material such as a carrier, a developing sleeve or a layer-forming blade which is in contact with a toner during the developing process (such a material will hereinafter categorically be referred to as "a charge-imparting material", which generally represents a material or a part capable of imparting an electric charge required for the development of a toner or capable of imparting an electric charge supplementally, in contact with the toner during or prior to the developing step). As such a charge-imparting material, one having high durability against friction with the toner, is required, and as a carrier, one which is useful for a long period of time without replacement, is desired.

Under these circumstances, the present inventors have conducted extensive studies to provide an electrostatic image-developing toner of high quality which is excellent in the charge stability even without containing a metal and which scarcely brings about copy staining and to provide a charge-imparting material which is free from deterioration in the performance during use for a long period of time and which provides an image excellent in gradation and fine line reproducibility. As a result, they have found it possible to solve the above-mentioned problems by employing a compound having a certain specific structure as the charge controlling agent.

Namely, the object of the present invention is to provide a charge controlling agent which is excellent in the charge stability even without containing a metal and which is excellent also in other properties required for a toner, such as moisture resistance, light resistance and heat resistance.

Another object of the present invention is to provide a charge-imparting material and a toner of high quality, whereby the print density is proper and stable even during continuous use or in an adverse environment and copy staining scarcely results.

A still another object of the present invention is to provide a charge controlling agent excellent in the safety.

Accordingly, the present invention provides a charge controlling agent for electrostatic image development, which is a compound of the formula (I):

$$Ar_1—(X—Ar_2)_n \qquad (I)$$

wherein each of $Ar_1$ and $Ar_2$ is a substituted or unsubstituted aromatic ring residue, X is a member selected from the group consisting of —CONH—, —NHCO—, —$SO_2$NH— and —NH$SO_2$—, and n is an integer of at least 2, provided that a plurality of $Ar_2$, or a plurality of X, are the same or different groups from one another, and a toner and a charge imparting material employing it.

Now, the present invention will be described in detail with reference to the preferred embodiments.

In the above formula (I), each of $Ar_1$ and $Ar_2$ may be a carbon ring or a hetero ring, or the one having carbon rings, hetero rings, or a carbon ring and a hereto ring, condensed to each other. Specific examples of $Ar_1$ or $Ar_2$ include $C_{4-30}$ aromatic ring residues, such as a benzene ring residue, a naphthalene ring residue, an anthracene ring residue, a phenanthrene ring residue, a carbazole ring residue, a fluorene ring residue, a fluorenone ring residue, a dibenzofuran ring residue, a dibenzothiophene ring residue, and a benzocarbazole ring residue. Particularly preferred is a benzene ring residue or a naphthalene ring residue. $Ar_1$ and $Ar_2$ may be the same or different from each other. The compound of the formula (I) has a plurality of $Ar_2$. In the present invention, the plurality of $Ar_2$ may not necessarily be the same aromatic ring residues, and the above formula (I) includes a case where the plurality of $Ar_2$ are different from one another.

Each of $Ar_1$ and $Ar_2$ may be unsubstituted or substituted. Specific examples of the substituents include an alkyl group which may be substituted (preferably the one having from 1 to 6 carbon atoms), such as a methyl group, an ethyl group, a n-propyl group, an iso-propyl group, a n-butyl group, an iso-butyl group, a tert-butyl group, a haloalkyl group (such as a fluoromethyl group, a difluoromethyl group, a trifluoromethyl group, a chloromethyl group, a bromomethyl group, a fluoroethyl group, a fluoropropyl group or a fluorobutyl group), a hydroxyalkyl group (such as a hydroxymethyl group, a dihydroxymethyl group, a trihydroxymethyl group, a hydroxyethyl group, a hydroxypropyl group or a hydroxybutyl group), an amino group which may be substituted (preferably the one having from 0 to 10 carbon atoms), such as an amino group, an alkylamino group or a dialkylamino group, an alkoxyl group (preferably the one having from 1 to 6 carbon atoms), such as a methoxyl group, an ethoxyl group, a n-propoxyl group, an iso-propoxyl group, a n-butoxyl group, an iso-butoxyl group or a tert-butoxyl group, a hydroxyl group, a halogen atom such as a fluorine atom, a chlorine atom or a bromine atom, a nitro group, and a phenyl group. Particularly preferred are an alkyl group which may be substituted (especially a haloalkyl group), a hydroxyl group and a halogen atom. Among them, especially preferred are a fluoroalkyl group having at least one fluorine atom, and a chlorine atom. When both $Ar_1$ and $Ar_2$ have substituents, $Ar_1$ and $Ar_2$ may have different substituents, and a plurality of $Ar_2$ may have different substituents from one another. Further, when $Ar_1$ or $Ar_2$ has a plurality of substituents, such substituents may be the same or different from one another. The number of substituents is preferably at most 4 (excluding X) in the case of $Ar_1$ and at most 5 (excluding X) in the case of $Ar_2$.

Also with respect to a plurality of X, the above formula (I) includes a case where they are different from one another, like the case of $Ar_2$. X is preferably —CONH— or —NHCO—. n is an integer of at least 2, preferably from 2 to 4, particularly preferably 2.

$Ar_1$ is preferably a benzene ring residue which is unsubstituted or substituted by an alkyl group, excluding the substitution by X. Specifically, $Ar_1$ is preferably a m-phenylene group, a 5-tert-butyl-m-phenylene group, or a p-phenylene group. $Ar_2$ is preferably a benzene ring residue substituted by one or two haloalkyl groups or halogen atoms. Specifically, $Ar_2$ is preferably a 3,4-dichlorophenyl group, a 4-chlorophenyl group, or a 3,5-bis(trifluoromethyl)phenyl group, and more preferred is a compound having a combination thereof. It is preferred that all $Ar^2$ are the same aromatic ring residue.

Particularly preferred compounds are compound Nos. (6), (8), (65), (66), (73), (74) and (75) among the specific compounds given as examples hereinafter.

The compound of the formula (I) wherein X=—CONH—, can be readily prepared by the following synthesis. For example, compounds of the formulas (II) and (III):

$$Ar_1—(COCl)_n \quad (II)$$

$$Ar_2—NH_2 \quad (III)$$

wherein $Ar_1$ and $Ar_2$ are the same as defined in the above formula (I), are charged into a reaction system in a molar ratio of (II)/(III)=½ when n is 2, (II)/(III)=⅓ when n is 3, or (II)/(III)=¼ when n is 4, and reacted in a solvent such as toluene or pyridine.

Among the compounds of the formula (I), preferred specific examples may be compounds represented by the following structural formulas, but the preferred examples are not limited thereto.

SPECIFIC COMPOUNDS

The position of X on $Ar_1$ is shown by o-, m- or p-, or by a numeral in accordance with IUPAC. A plurality of X may be different, and therefore identified by $X_n$, $X_{n-1}$ and $X_{n-2}$, respectively. With respect to the aromatic ring residue $Ar_1$, for example, a benzene ring residue is represented simply by "benzene".

TABLE 1

(n = 2 or 3, and pluralities of $Ar_2$ and X are the same)
$Ar_1—(X—Ar_2)_n$ (I)

| $Ar_1$ | | | X | | | | |
|---|---|---|---|---|---|---|---|
| No. | Aromatic ring residue | Position | $X_n$ | $X_{n-1}$ | $X_{n-2}$ | $Ar_2$ | n |
| (1) | Benzene | o- | CONH | CONH | — | Phenyl | 2 |
| (2) | Benzene | m- | CONH | CONH | — | Phenyl | 2 |
| (3) | Benzene | p- | CONH | CONH | — | Phenyl | 2 |
| (4) | Benzene | o- | CONH | CONH | — | p-Chlorophenyl | 2 |
| (5) | Benzene | m- | CONH | CONH | — | p-Chlorophenyl | 2 |
| (6) | Benzene | p- | CONH | CONH | — | p-Chlorophenyl | 2 |
| (7) | Benzene | o- | CONH | CONH | — | 3,4-Dichlorophenyl | 2 |
| (8) | Benzene | m- | CONH | CONH | — | 3,4-Dichlorophenyl | 2 |
| (9) | Benzene | p- | CONH | CONH | — | 3,4-Dichlorophenyl | 2 |
| (10) | Benzene | m- | CONH | CONH | — | p-Bromophenyl | 2 |
| (11) | Benzene | m- | CONH | CONH | — | p-Fluorophenyl | 2 |
| (12) | Benzene | p- | CONH | CONH | — | p-n-Butylphenyl | 2 |
| (13) | Benzene | m- | CONH | CONH | — | p-Methoxyphenyl | 2 |
| (14) | 4-Methylbenzene | 1,2 | CONH | CONH | — | p-Chlorophenyl | 2 |
| (15) | 4-Chlorobenzene | 1,2 | CONH | CONH | — | 3,4-Dichlorophenyl | 2 |
| (16) | Benzene | 1,3,5 | CONH | CONH | CONH | p-Chlorophenyl | 3 |
| (17) | Benzene | 1,3,5 | CONH | CONH | CONH | Phenyl | 3 |
| (18) | Benzene | 1,3,5 | CONH | CONH | CONH | 3,4-Dichlorophenyl | 3 |
| (19) | Benzene | o- | NHCO | NHCO | — | Phenyl | 2 |
| (20) | Benzene | m- | NHCO | NHCO | — | Phenyl | 2 |
| (21) | Benzene | p- | NHCO | NHCO | — | Phenyl | 2 |

TABLE 1-continued (n = 2 or 3, and pluralities of $Ar_2$ and X are the same)
$Ar_1—(X—Ar_2)_n$ (I)

| $Ar_1$ | | | X | | | | |
|---|---|---|---|---|---|---|---|
| No. | Aromatic ring residue | Position | $X_n$ | $X_{n-1}$ | $X_{n-2}$ | $Ar_2$ | n |
| (22) | Benzene | m- | NHCO | NHCO | — | p-Methylphenyl | 2 |
| (23) | Benzene | m- | NHCO | NHCO | — | 3,4-Dichlorophenyl | 2 |
| (24) | Benzene | o- | NHCO | NHCO | — | 3,4-Dichlorophenyl | 2 |
| (25) | Benzene | p- | NHCO | NHCO | — | 3,4-Dichlorophenyl | 2 |
| (26) | Benzene | m- | NHCO | NHCO | — | p-Chlorophenyl | 2 |
| (27) | Benzene | p- | NHCO | NHCO | — | 2,4,6-Trichlorophenyl | 2 |
| (28) | Benzene | m- | NHCO | NHCO | — | 2,4,6-Trichlorophenyl | 2 |
| (29) | 2,5-Dichlorobenzene | 1,4 | NHCO | NHCO | — | 2-Hydroxy-3,5-di-tert-butylphenyl | 2 |
| (30) | Benzene | p- | NHCO | NHCO | — | 2-Hydroxy-3,5-di-tert-butylphenyl | 2 |
| (31) | 2,5-Dichlorobenzene | 1,4 | NHCO | NHCO | — | 2-Hydroxy-3,5-dichlorophenyl | 2 |
| (32) | Benzene | p- | NHCO | NHCO | — | 2-Hydroxy-3,5-dichlorophenyl | 2 |
| (33) | 2,5-Dimethylbenzene | 1,4 | NHCO | NHCO | — | 3,4-Dichlorophenyl | 2 |
| (34) | 2,5-Dimethylbenzene | 1,4 | NHCO | NHCO | — | p-Chlorophenyl | 2 |
| (35) | Benzene | m- | NHCO | NHCO | — | m-Nitrophenyl | 2 |
| (36) | Benzene | p- | NHCO | NHCO | — | m-Nitrophenyl | 2 |
| (37) | Benzene | p- | NHCO | NHCO | — | p-Nitrophenyl | 2 |
| (38) | Benzene | o- | NHCO | NHCO | — | p-Fluorophenyl | 2 |
| (39) | Benzene | m- | NHCO | NHCO | — | p-Fluorophenyl | |
| (40) | Benzene | p- | NHCO | NHCO | — | p-Fluorophenyl | 2 |
| (41) | Naphthalene | 2,3 | NHCO | NHCO | — | 3,4-Dichlorophenyl | 2 |
| (42) | Naphthalene | 1,5 | NHCO | NHCO | — | 3,4-Dichlorophenyl | 2 |
| (43) | 2-Nitrobenzene | 1,4 | NHCO | NHCO | — | 3,4-Dichlorophenyl | 2 |
| (44) | Carbazole | 3,6 | NHCO | NHCO | — | p-Chlorophenyl | 2 |
| (45) | Fluorene | 2,7 | NHCO | NHCO | — | p-Chlorophenyl | 2 |
| (46) | Benzene | o- | $NHSO_2$ | $NHSO_2$ | — | p-Chlorophenyl | 2 |
| (47) | Benzene | m- | $NHSO_2$ | $NHSO_2$ | — | p-Chlorophenyl | 2 |
| (48) | Benzene | p- | $NHSO_2$ | $NHSO_2$ | — | p-Chlorophenyl | 2 |
| (49) | Benzene | m- | $NHSO_2$ | $NHSO_2$ | — | p-Methylphenyl | 2 |
| (50) | Benzene | m- | $NHSO_2$ | $NHSO_2$ | — | 2,4,5-Trichlorophenyl | 2 |
| (51) | Benzene | m- | $NHSO_2$ | $NHSO_2$ | — | p-Methoxyphenyl | 2 |
| (52) | Benzene | p- | $NHSO_2$ | $NHSO_2$ | — | p-Nitrophenyl | 2 |
| (53) | Benzene | m- | $SO_2NH$ | $SO_2NH$ | — | Phenyl | 2 |
| (54) | Benzene | o- | $SO_2NH$ | $SO_2NH$ | — | Phenyl | 2 |
| (55) | Benzene | m- | $SO_2NH$ | $SO_2NH$ | — | 3,4-Dichlorophenyl | 2 |
| (56) | Benzene | o- | $SO_2NH$ | $SO_2NH$ | — | 3,4-Dichlorophenyl | 2 |
| (57) | Benzene | m- | $SO_2NH$ | $SO_2NH$ | — | p-Chlorophenyl | 2 |
| (58) | Benzene | m- | $SO_2NH$ | $SO_2NH$ | — | 2,4,6-Trichlorophenyl | 2 |
| (59) | Benzene | m- | $SO_2NH$ | $SO_2NH$ | — | p-Bromophenyl | 2 |
| (60) | Benzene | m- | $SO_2NH$ | $SO_2NH$ | — | p-Fluorophenyl | 2 |
| (61) | Benzene | m- | CONH | CONH | — | m-Trifluoro-methylphenyl | 2 |
| (62) | Benzene | p- | CONH | CONH | — | m-Trifluoro-methylphenyl | 2 |
| (63) | Benzene | m- | CONH | CONH | — | p-Trifluoro-methylphenyl | 2 |
| (64) | Benzene | p- | CONH | CONH | — | p-Trifluoro-methylphenyl | 2 |
| (65) | Benzene | m- | CONH | CONH | — | 3,5-bis(Trifluoro-methyl)phenyl | 2 |
| (66) | Benzene | p- | CONH | CONH | — | 3,5-bis(Trifluoro-methyl)phenyl | 2 |
| (67) | Benzene | p- | CONH | CONH | — | m-Bromophenyl | 2 |
| (68) | Benzene | 1,3,5 | CONH | CONH | CONH | M-Trifluoro-methylphenyl | 3 |
| (69) | Benzene | 1,3,5 | CONH | CONH | CONH | p-Trifluoro-methylphenyl | 3 |
| (70) | Benzene | 1,3,5 | CONH | CONH | CONH | 3,5-bis(Trifluoro-methyl)phenyl | 3 |
| (71) | Benzene | 1,3,5 | CONH | CONH | CONH | p-Fluorophenyl | 3 |
| (72) | Benzene | m- | CONH | CONH | — | p-tert-Butylphenyl | 2 |
| (73) | 5-tert-Butylbenzene | 1,3 | CONH | CONH | — | 3,5-bis(Trifluoro-methyl)phenyl | 2 |

TABLE 1-continued (n = 2 or 3, and pluralities of $Ar_2$ and X are the same)
$Ar_1—(X—Ar_2)_n$ (I)

| | $Ar_1$ | | X | | | | |
|---|---|---|---|---|---|---|---|
| No. | Aromatic ring residue | Position | $X_n$ | $X_{n-1}$ | $X_{n-2}$ | $Ar_2$ | n |
| (74) | 5-tert-Butylbenzene | 1,3 | CONH | CONH | — | m-Trifluoro-methylphenyl | 2 |
| (75) | 5-tert-Butylbenzene | 1,3 | CONH | CONH | — | p-Trifluoro-methylphenyl | 2 |

TABLE 2

(n = 4, and pluralities of $Ar_2$ and X are the same)

| | $Ar_1$ | | | | |
|---|---|---|---|---|---|
| No. | Aromatic ring residue | Position | X | $Ar_2$ | n |
| (76) | Benzene | 1,2,4,5 | CONH | 3,4-Dichlorophenyl | 4 |
| (77) | Benzene | 1,2,4,5 | CONH | p-Chlorophenyl | 4 |
| (78) | Benzene | 1,2,4,5 | CONH | Phenyl | 4 |

TABLE 3

(n = 2 or 3, and pluralities of $Ar_2$ and/or X are different)

| | $Ar_1$ | | X | | | $Ar_2$(*) | | | |
|---|---|---|---|---|---|---|---|---|---|
| No. | Aromatic ring residue | Position | $X_n$ | $X_{n-1}$ | $X_{n-2}$ | $X_n$:$Ar_2'$ | $X_{n-1}$:$Ar_2''$ | $X_{n-2}$:$Ar_2'''$ | n |
| (79) | Benzene | m- | CONH | NHCO | — | Phenyl | p-Chlorophenyl | — | 2 |
| (80) | Benzene | p- | CONH | NHCO | — | Phenyl | 3,4-Dichlorophenyl | — | 2 |
| (81) | Benzene | o- | CONH | NHCO | — | Phenyl | p-Fluorophenyl | — | 2 |
| (82) | Benzene | m- | $NHSO_2$ | CONH | — | p-Chlorophenyl | Phenyl | — | 2 |
| (83) | Benzene | m- | $NHSO_2$ | $SO_2NH$ | — | Phenyl | Phenyl | — | 2 |
| (84) | Benzene | 1,2,4 | CONH | CONH | $SO_2NH$ | Phenyl | Phenyl | Phenyl | 3 |

*A plurality of $Ar_2$ bonded to the respective X's are designated as $Ar_2'$, $Ar_2''$, $Ar_2'''$.

Now, use of the charge controlling agent of the present invention as a toner will be described.

The toner comprises at least the charge controlling agent, a resin and a colorant.

The resin for the toner of the present invention may be selected from a wide range including known resins. For example, a styrene resin (a homopolymer or a copolymer of styrene or a substituted styrene) such as a polystyrene, a polychlorostyrene, a poly-α-methyl styrene, a styrene-chlorostyrene copolymer, a styrene-propylene copolymer, a styrene-butadiene copolymer, a styrene-vinyl chloride copolymer, a styrene-vinyl acetate copolymer, a styrene-maleic acid copolymer, a styrene-acrylate copolymer (such as a styrene-methyl acrylate copolymer, a styrene-ethyl acrylate copolymer, a styrene-butyl acrylate copolymer, a styrene-octyl acrylate copolymer or a styrene-phenyl acrylate copolymer), a styrene-methacrylate copolymer (such as styrene-methyl methacrylate copolymer, a styrene-ethyl methacrylate copolymer, a styrene-butyl methacrylate copolymer or a styrene-phenyl methacrylate copolymer), a styrene-methyl α-chloroacrylate copolymer, or a styrene-acrylonitrile-acrylate copolymer, a vinyl chloride resin, a rosin-modified maleic acid resin, a phenol resin, an epoxy resin, a polyester resin (inclusive of saturated and unsaturated), a low molecular weight polyethylene, a low molecular weight polypropylene, an ionomer resin, a polyurethane resin, a silicone resin, a ketone resin, an ethylene-ethyl acrylate copolymer, a xylene resin, or a polyvinyl butyral resin, may be mentioned. Particularly preferred as the resin to be used in the present invention, is a styrene-acrylate copolymer, a styrene-methacrylate copolymer, a polyester resin or an epoxy resin.

The colorant to be incorporated to the toner may be selected from a wide range including known colorants. For example, carbon black, lamp black, iron black, ultramarine blue, Nigrosine dye, aniline blue, phthalocyanine blue, phthalocyanine green, Hansa Yellow, Chrome Yellow, Rose Bengale, a triarylmethane type dye, a monoazo dye pigment, or a disazo dye pigment may be mentioned.

The compound of the above formula (I) is white and may be incorporated to a colored toner of e.g. blue, red or yellow. In such a case, a colorant composed of a dye or pigment having the corresponding color, is used. The amount of the colorant is preferably from 3 to 20 parts by weight, per 100 parts by weight of the resin.

As a method for incorporating the compound of the above formula (I) to the toner, it is possible to employ an internally incorporating method wherein the compound is added and mixed together with a resin into the toner, or an externally incorporating method wherein it is added after forming toner particles. The internally incorporating method is more common and preferred. The amount of the compound of the formula (I) in the toner is preferably from 0.1 to 20 parts by weight, more preferably from 0.1 to 15 parts by weight, still more preferably from 0.5 to 5 parts by weight, per 100 parts by weight of the resin. If the content of the compound of the formula (I) is too small, the effect of improving the electric charge can not be improved, and if it is excessive, the quality of the toner tends to deteriorate.

To the toner of the present invention, in addition to the compound of the above formula (I), other charge controlling agents inclusive of known agents, such as a Nigrosine dye, a quaternary ammonium salt or a metal-containing complex compound, may be incorporated. Further, to the toner of the present invention, other known additives such as a solid electrolyte, a polymer electrolyte, a charge transfer complex, an electroconductor of e.g. a metal oxide such as tin oxide, a semiconductor or a ferroelectric substance, a magnetic substance, etc., may be incorporated to control the electrical properties of the toner. Further, for the purpose of controlling the thermal properties or physical properties, additives of e.g. various plasticizers or release agents such as a low molecular weight olefin polymer may also be incorporated to the toner. Further, it is possible to add fine powder of $TiO_2$, $Al_2O_3$ or $SiO_2$ to the toner and to cover the surface of toner particles with it to improve the flowability or aggregation resistance of the toner.

The charge controlling agent of the present invention is particularly useful for a negatively chargeable toner.

The toner may be prepared by a method which comprises kneading the above-mentioned various components by e.g. a kneader, followed by cooling and then by pulverization and classification. However, the toner may be a capsulated toner or a polymerized toner. The toner of the present invention may be applied not only to a two component developer but also to a so-called one component magnetic developer (a magnetic toner) such as a magnetite-containing toner, or to a one component non-magnetic developer containing no magnetic material. The average particle size of the toner is preferably from 5 to 20 μm.

As the carrier to be mixed with the toner of the present invention to form a developer, a magnetic material such as a conventional iron powder type, ferrite type or magnetite type carrier, or the one having a resin coating applied to the surface of such magnetic material or a magnetic resin carrier, may be employed. As the coating resin for a resin coating carrier, a commonly known styrene type resin, an acryl type resin, a styrene-acryl copolymer type resin, a silicone type resin, a modified silicone type resin, a fluorine type resin or a mixture of such resins may be used, but the coating resin is not limited to such specific examples. The average particle size of the carrier is not particularly limited, but the one having an average particle size of from 10 to 200 μm is preferred. Such a carrier is preferably used in an amount of from 5 to 100 parts by weight, per part by weight of the toner.

Now, application of the charge controlling agent of the present invention to a charge-imparting material will be described.

The charge-imparting material has the compound of the above formula (I) at least on a part of its surface.

The charge-imparting material of the present invention can be obtained by forming a coating layer containing the charge controlling agent of the present invention on a base material by a method wherein a coating liquid obtained by dissolving or dispersing the charge controlling agent of the present invention in a solvent or a dispersing medium, if necessary, together with a binder resin, is coated on the base material for the charge-imparting material by dipping, spraying or brush coating, or in the case where the base material is carrier particles, by a method wherein such carrier particles are impregnated and mixed with the above coating liquid, followed by drying, or a method wherein coating is carried out by a fluidized bed of a direct mixture with the base material. Otherwise, a charge-imparting material may be prepared by directly melt-kneading a binder resin and the charge controlling agent, and extruding and laminating the kneaded material on a base material. Further, the charge controlling agent may be incorporated into a moldable resin, and the mixture is molded in the form of carrier particles, a developing sleeve or a layer-forming blade to obtain a charge-imparting material.

Now, the present invention will be described in further detail with reference to Examples. However, it should be understood that the present invention is by no means restricted by such specific Examples. In the following Examples, "parts" means "parts by weight".

PREPARATION EXAMPLE

Into a 500 ml round bottom flask, 60.0 g of 3,5-bis (trifluoromethyl)aniline, 125 ml of toluene and 45 ml of an aqueous sodium hydroxide solution (containing 10.48 g of NaOH) were charged, and while stirring the mixture under cooling with ice (from 0° to 10° C.), a solution having 26.6 g of isophthaloyl chloride dissolved in 60 ml of toluene, was further dropwise added over a period of 30 minutes. (Upon the addition, white crystals precipitated.) Then, this solution was heated at 50° C. and stirred for 2 hours. Heating was stopped, and after cooling to room temperature, the reaction product was collected by filtration. This reaction product was washed three times with 1000 ml of a 1N NaOH aqueous solution, once with 1000 ml of a 1N HCl aqueous solution, and once with 1000 ml of water and dried under reduced pressure at 80° C. to obtain 36.02 g of a white powder material (compound No. 65). The melting point of the obtained material was 258.0° to 259.0° C.

EXAMPLE 1

| | |
|---|---|
| Polyester type resin (FC-023, manufactured by Mitsubishi Rayon Co., Ltd.) | 100 parts |
| Carbon black (MA-100, manufactured by Mitsubishi Chemical Corporation) | 4 parts |
| Compound No. (5) | 3 parts |

The above materials were blended and kneaded, followed by pulverization and classification to obtain a black toner having an average particle size of 9 μm. Five parts of this toner and 100 parts of a ferrite carrier having an average particle size of about 100 μm, were mixed and stirred to obtain a developer. Then, using this developer, a copy was taken by a copying machine employing selenium as a photoreceptor, whereby a clear copy was obtained.

EXAMPLE 2

The operation was conducted in the same manner as in Example 1 except that 3 parts of compound (7) was used as the charge controlling agent, whereby a clear copy was obtained as in Example 1.

EXAMPLE 3

The operation was conducted in the same manner as in Example 1 except that 3 parts of compound (8) was used as the charge controlling agent, whereby a clear copy was obtained as in Example 1.

EXAMPLE 4

The operation was conducted in the same manner as in Example 1 except that 3 parts of compound (9) was used as the charge controlling agent, whereby a clear copy was obtained as in Example 1.

EXAMPLE 5

The operation was conducted in the same manner as in Example 1 except that 3 parts of compound (11) was used as the charge controlling agent, whereby a clear copy was obtained as in Example 1.

EXAMPLE 6

The operation was conducted in the same manner as in Example 1 except that 3 parts of compound (20) was used as the charge controlling agent, whereby a clear copy was obtained as in Example 1.

EXAMPLE 7

The operation was conducted in the same manner as in Example 1 except that 3 parts of compound (23) was used as the charge controlling agent, whereby a clear copy was obtained as in Example 1.

EXAMPLE 8

The operation was conducted in the same manner as in Example 1 except that 3 parts of compound (26) was used as the charge controlling agent, whereby a clear copy was obtained as in Example 1.

EXAMPLE 9

The operation was conducted in the same manner as in Example 1 except that 3 parts of compound (28) was used as the charge controlling agent, whereby a clear copy was obtained as in Example 1.

EXAMPLE 10

The operation was conducted in the same manner as in Example 1 except that 3 parts of compound (30) was used as the charge controlling agent, whereby a clear copy was obtained as in Example 1.

EXAMPLE 11

The operation was conducted in the same manner as in Example 1 except that 3 parts of compound (32) was used as the charge controlling agent, whereby a clear copy was obtained as in Example 1.

EXAMPLE 12

The operation was conducted in the same manner as in Example 1 except that 3 parts of compound (39) was used as the charge controlling agent, whereby a clear copy was obtained as in Example 1.

EXAMPLE 13

The operation was conducted in the same manner as in Example 1 except that 3 parts of compound (47) was used as the charge controlling agent, whereby a clear copy was obtained as in Example 1.

EXAMPLE 14

The operation was conducted in the same manner as in Example 1 except that 3 parts of compound (50) was used as the charge controlling agent, whereby a clear copy was obtained as in Example 1.

EXAMPLE 15

The operation was conducted in the same manner as in Example 1 except that 3 parts of compound (55) was used as the charge controlling agent, whereby a clear copy was obtained as in Example 1.

EXAMPLE 16

The operation was conducted in the same manner as in Example 1 except that 3 parts of compound (76) was used as the charge controlling agent, whereby a clear copy was obtained as in Example 1.

EXAMPLE 17

The operation was conducted in the same manner as in Example 1 except that 3 parts of compound (61) was used as the charge controlling agent, whereby a clear copy was obtained as in Example 1.

EXAMPLE 18

The operation was conducted in the same manner as in Example 1 except that 3 parts of compound (62) was used as the charge controlling agent, whereby a clear copy was obtained as in Example 1.

EXAMPLE 19

The operation was conducted in the same manner as in Example 1 except that 3 parts of compound (64) was used as the charge controlling agent, whereby a clear copy was obtained as in Example 1.

EXAMPLE 20

The operation was conducted in the same manner as in Example 1 except that 3 parts of compound (65) was used as the charge controlling agent, whereby a clear copy was obtained as in Example 1.

EXAMPLE 21

The operation was conducted in the same manner as in Example 1 except that 3 parts of compound (66) was used as the charge controlling agent, whereby a clear copy was obtained as in Example 1.

EXAMPLE 22

The operation was conducted in the same manner as in Example 1 except that 3 parts of compound (68) was used as the charge controlling agent, whereby a clear copy was obtained as in Example 1.

EXAMPLE 23

The operation was conducted in the same manner as in Example 1 except that 3 parts of compound (70) was used as the charge controlling agent, whereby a clear copy was obtained as in Example 1.

EXAMPLE 24

The operation was conducted in the same manner as in Example 1 except that 3 parts of compound (71) was used as the charge controlling agent, whereby a clear copy was obtained as in Example 1.

EXAMPLE 25

The operation was conducted in the same manner as in Example 1 except that 3 parts of compound (6) was used as the charge controlling agent, whereby a clear copy was obtained as in Example 1.

stirring time was measured by blow off. The quantity of the electric charge is shown below.

For the purpose of comparison, the quantities of the electric charges of conventional charge controlling agents measured in the same manner are shown.

TABLE 4

| Compound No. | Quantity of electric charge against stirring time | | |
|---|---|---|---|
| | 5 min | 10 min | 30 min |
| (6) | −48.9 μC/g | −49.3 μC/g | −55.0 μC/g |
| (8) | −72.2 μC/g | −73.0 μC/g | −88.6 μC/g |
| (9) | −49.5 μC/g | −50.7 μC/g | −56.0 μC/g |
| (18) | −49.3 μC/g | −50.9 μC/g | −55.1 μC/g |
| (23) | −44.8 μC/g | −47.1 μC/g | −59.3 μC/g |
| (65) | −50.3 μC/g | −50.5 μC/g | −57.6 μC/g |
| (66) | −49.5 μC/g | −50.2 μC/g | −58.6 μC/g |
| (73) | −75.6 μC/g | −78.0 μC/g | −79.1 μC/g |
| Comparative Compound 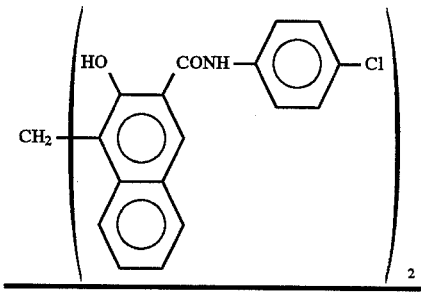 | −45.1 μC/g | −39.5 μC/g | −40.0 μC/g |

EXAMPLE 26

The operation was conducted in the same manner as in Example 1 except that 3 parts of compound (73) was used as the charge controlling agent, whereby a clear copy was obtained as in Example 1.

EXAMPLE 27

The operation was conducted in the same manner as in Example 1 except that 3 parts of compound (74) was used as the charge controlling agent, whereby a clear copy was obtained as in Example 1.

EXAMPLE 28

The operation was conducted in the same manner as in Example 1 except that 3 parts of compound (75) was used as the charge controlling agent, whereby a clear copy was obtained as in Example 1.

EXAMPLE 29

The quantity of the electric charge of the compound of the present invention was measured as follows.

One wt % of a sample passed through 400 mesh was mixed with a styrene-acryl resin having an average particle size of 10 μm, and the mixture was blended for 60 seconds by a mixer. One wt % of this mixture was mixed to an iron powder having an average particle size of 100 μm and stirred, and the quantity of the electric charge against the The electrostatic image-developing toner and the charge-imparting material employing the charge controlling agent for electrostatic image development of the present invention, have excellent safety and charge stability, and they are an electrostatic image-developing toner and charge-imparting material of high quality, whereby no copy staining will result even by continuous copying.

We claim:

1. An electrostatic image-developing toner comprising a resin, a colorant and a charge controlling agent for electrostatic image development, which is a compound of the formula (I):

$$Ar_1—(X—Ar_2)_n \quad (I)$$

wherein each of $Ar_1$ and $Ar_2$ is substituted or unsubstituted aromatic ring residue, X is a member selected from the group consisting of —CONH—, —NHCO—, —$SO_2$NH— and —NH$SO_2$—, and n is an integer of at least 2, provided that a plurality of $Ar_2$, or a plurality of X, are the same or different groups from one another, wherein said charge controlling agent is internally incorporated in said electrostatic image-developing toner and imparts negative charge to said electrostatic image-developing toner.

2. The electrostatic image-developing toner according to claim 1, wherein n is at most 4.

3. The electrostatic image-developing toner according to claim 1, wherein $Ar_1$ is a substituted or unsubstituted $C_{4-30}$ aromatic ring residue.

4. The electrostatic image-developing toner according to claim 3, wherein $Ar_1$ is a substituted or unsubstituted benzene ring residue, or a substituted or unsubstituted naphthalene ring residue.

5. The electrostatic image-developing toner according to claim 1, wherein a substituent of $Ar_1$ is at least one member selected from the group consisting of a substituted or unsubstituted alkyl group, a hydroxyl group and a halogen atom.

6. The electrostatic image-developing toner according to claim 4, wherein $Ar_1$ is a benzene ring residue which is unsubstituted or substituted by an alkyl group.

7. The electrostatic image-developing toner according to claim 6, wherein $Ar_1$ is an m-phenylene group, a 5-tert-butyl-m-phenylene group, or a p-phenylene group.

8. The electrostatic image-developing toner according to claim 1, wherein the number of substituents for $Ar_1$ other than X is at most 4.

9. The electrostatic image-developing toner according to claim 1, wherein $Ar_2$ is a substituted or unsubstituted $C_{4-30}$ aromatic ring residue.

10. The electrostatic image-developing toner according to claim 9, wherein $Ar_2$ is a substituted or unsubstituted benzene ring residue, or a substituted or unsubstituted naphthalene ring residue.

11. The electrostatic image-developing toner according to claim 1, wherein a substituent of $Ar_2$ is at least one member selected from the group consisting of a substituted or unsubstituted alkyl group, a hydroxyl group and a halogen atom.

12. The electrostatic image-developing toner according to claim 11, wherein a substituent of $Ar_2$ is at least one member selected from the group consisting of a haloalkyl group, a hydroxyl group and a halogen atom.

13. The electrostatic image-developing toner according to claim 12, wherein a substituent of $Ar_2$ is at least one member selected from the group consisting of a fluoroalkyl group having at least one fluorine atom, and a chlorine atom.

14. The electrostatic image-developing toner according to claim 10, wherein $Ar_2$ is a benzene ring residue substituted by at least one member selected from the group consisting of a haloalkyl group and a halogen atom.

15. The electrostatic image-developing toner according to claim 14, wherein $Ar_2$ is a benzene ring residue selected from the group consisting of a 3,4-dichlorophenyl group, a 4-chlorophenyl group and a 3,5-bis(trifluoromethyl)phenyl group.

16. The electrostatic image-developing toner according to claim 1, wherein the number of substituents for $Ar_2$ other than X is at most 5.

17. The electrostatic image-developing toner according to claim 1, wherein X is a member selected from the group consisting of —CONH— and —NHCO—.

18. A charge-imparting material for electrostatic image development having a charge controlling agent for electrostatic image development at least on a part of its surface, and the charge controlling agent for electrostatic image development is a compound of the formula (I):

$$Ar_1—(X—Ar_2)_n \quad (I)$$

wherein each of $Ar_1$ and $Ar_2$ is a substituted or unsubstituted aromatic ring residue, X is a member selected from the group consisting of —CONH—, —NHCO—, $-SO_2NH-$ and $—NHSO_2—$, and n is an integer of at least 2, provided that a plurality of $Ar_2$, or a plurality of X, are the same or different groups from one another, wherein said charge controlling agent imparts negative charge to said charge-imparting material.

19. The charge-imparting material for electrostatic image development according to claim 18, wherein n is at most 4.

20. The charge-imparting material for electrostatic image development according to claim 18, wherein $Ar_1$ is a substituted or unsubstituted $C_{4-30}$ aromatic ring residue.

21. The charge-imparting material for electrostatic image development according to claim 20, wherein $Ar_1$ is a substituted or unsubstituted benzene ring residue, or a substituted or unsubstituted naphthalene ring residue.

22. The charge-imparting material for electrostatic image development according to claim 18, wherein a substituent of $Ar_1$ is at least one member selected from the group consisting of a substituted or unsubstituted alkyl group, a hydroxyl group and a halogen atom.

23. The charge-imparting material for electrostatic image development according to claim 21, wherein $Ar_1$ is a benzene ring residue which is unsubstituted or substituted by an alkyl group.

24. The charge-imparting material for electrostatic image development according to claim 23, wherein $Ar_1$ is an m-phenylene group, a 5-tert-butyl-m-phenylene group, or a p-phenylene group.

25. The charge-imparting material for electrostatic image development according to claim 18, wherein the number of substituents for $Ar_1$ other than X is at most 4.

26. The charge-imparting material for electrostatic image development according to claim 18, wherein $Ar_2$ is a substituted or unsubstituted $C_{4-30}$ aromatic ring residue.

27. The charge-imparting material for electrostatic image development according to claim 26, wherein $Ar_2$ is a substituted or unsubstituted benzene ring residue, or a substituted or unsubstituted naphthalene ring residue.

28. The charge-imparting material for electrostatic image development according to claim 18, wherein a substituent of $Ar_2$ is at least one member selected from the group consisting of a substituted or unsubstituted alkyl group, a hydroxyl group and a halogen atom.

29. The charge-imparting material for electrostatic image development according to claim 28, wherein a substituent of $Ar_2$ is at least one member selected from the group consisting of a haloalkyl group, a hydroxyl group and a halogen atom.

30. The charge-imparting material for electrostatic image development according to claim 29, wherein a substituent of $Ar_2$ is at least one member selected from the group consisting of a fluoroalkyl group having at least one fluorine atom, and a chlorine atom.

31. The charge-imparting material for electrostatic image development according to claim 27, wherein $Ar_2$ is a benzene ring residue substituted by at least one member selected from the group consisting of a haloalkyl group and a halogen atom.

32. The charge-imparting material for electrostatic image development according to claim 31, wherein $Ar_2$ is a benzene ring residue selected from the group consisting of a 3,4-dichlorophenyl group, a 4-chlorophenyl group and a 3,5-bis(trifluoromethyl)phenyl group.

33. The charge-imparting material for electrostatic image development according to claim 18, wherein the number of substituents for $Ar_2$ other than X is at most 5.

34. The charge-imparting material for electrostatic image development according to claim 18, wherein X is a member selected from the group consisting of —CONH— and —NHCO—.

* * * * *